United States Patent [19]

Broers et al.

[11] Patent Number: 4,903,838

[45] Date of Patent: Feb. 27, 1990

[54] PRODUCT PACKAGE

[75] Inventors: Becky Broers; Lois Gaelen, both of New York, N.Y.

[73] Assignee: Noxell Corporation, Hunt Valley, Md.

[21] Appl. No.: 288,341

[22] Filed: Dec. 22, 1988

[51] Int. Cl.[4] ..... B65D 73/00

[52] U.S. Cl. ..... 206/459; 132/73; 132/75; 206/463; 206/823

[58] Field of Search ..... 132/73, 735, 75, 286, 132/294, 333; 206/457, 459, 461–463, 569, 581, 823

[56] References Cited

U.S. PATENT DOCUMENTS

| | | | |
|---|---|---|---|
| 1,974,466 | 9/1934 | Marshburn . | |
| 2,032,807 | 3/1936 | Masbach | 206/457 |
| 2,195,495 | 4/1940 | Popp | 132/73 |
| 2,212,397 | 8/1940 | Gomes et al. | 206/457 |
| 2,296,139 | 9/1942 | Blair | 132/73 |
| 2,721,561 | 10/1955 | Dyche | 206/459 |
| 2,789,689 | 4/1957 | Lewis . | |
| 3,762,545 | 10/1973 | Warner et al. | 206/459 |
| 4,106,614 | 8/1978 | Aylott | 206/823 |
| 4,373,632 | 2/1983 | Vanzandt | 206/457 |

FOREIGN PATENT DOCUMENTS

| | | | |
|---|---|---|---|
| 0535917 | 4/1941 | United Kingdom | 206/457 |
| 2129758 | 5/1984 | United Kingdom | 206/823 |

*Primary Examiner*—Jimmy G. Foster

*Attorney, Agent, or Firm*—Wolder, Gross & Bondell

[57] ABSTRACT

A make-up package in the form of a mounting card with a central opening therethrough, into which is mounted a make-up bottle having make-up therein of a certain color. Another opening is formed in the mounting card, across the center of which is placed a color strip, matching the color of make-up in the bottle. By placing, for example, the user's finger behind the other opening, the matching of skin color to make-up can be accomplished without opening the bottle.

2 Claims, 1 Drawing Sheet

FIG. 1
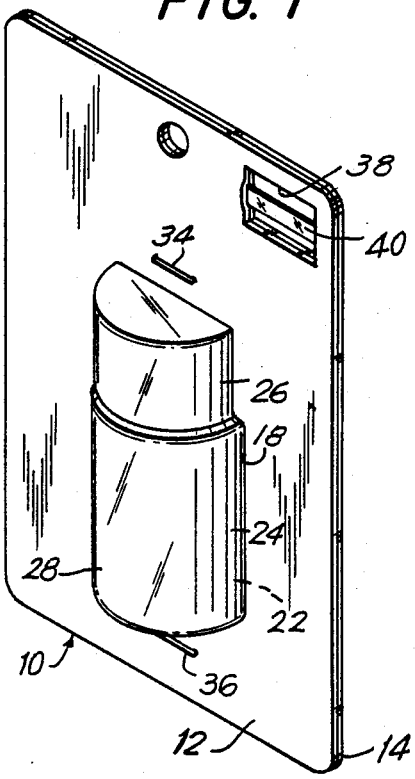
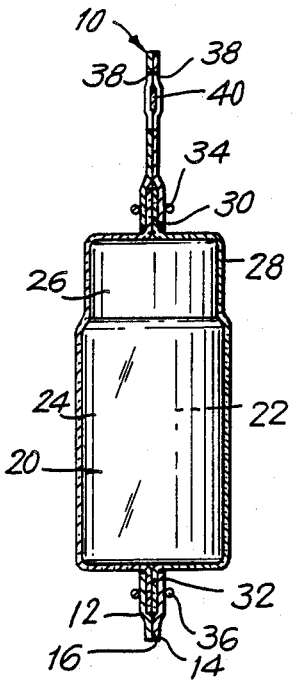
FIG. 3
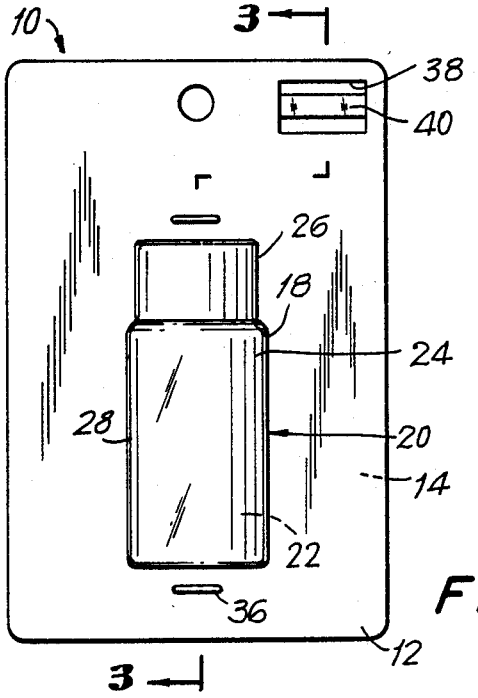
FIG. 2

PRODUCT PACKAGE

This invention relates primarily to packaging and more particularly to packaging for make-up or a like product where color is an important parameter for choice by the purchaser.

Very often, where color is a critical or important parameter for choice thereof by the purchaser, it is beneficial to do more than place the product in a clear bottle or container. For instance, in the case of make-up, the purchaser would like to compare the color of her skin to the make-up contained by the package in order to determine if the skin color and make-up will be compatible when the make-up is used. In a minority of cases, at least in better department stores, for instance, a sample of the make-up will be available for trying a very small amount on the potential user's skin. More often than not, such a convenience is not available and it should be taken into consideration that in a great majority of cases the make-up is packaged by a so-called "blister-pack".

The prior art shows that one solution to the problem discussed above is by means of the packaging concept disclosed in U.S. Pat. No. 2,789,689, issued Apr. 23, 1957, N. Lewis, Inventor. Of course, the solution in the Lewis patent involves a removable strip on a package of hair coloring which enables modular packaging, except for the disclosure of color on the removable strip.

Another solution to the problem relates to U.S. Pat. No. 1,974,466, issued Sept. 25, 1934, P. W. Marshburn, inventor. Marshburn displays a chart showing nail polish color for the convenience of purchasers in selecting different colors of nail polish.

In terms of the Marshburn concept, the carton for nail polish must be opened in order to remove the chart enabling the quick comparison by the potential purchaser with her nails or the nail polish at that time on her nails. In connection with Lewis, the so-called "label insert" must be removed for the comparison operation. In either case, there is a significant inconvenience in making the color comparison and, of course, neither would be suitable for "blister-packs".

Accordingly, a primary object of the present invention is to provide a package which enables a quick and convenient means for use by the purchaser in comparing her skin color to the color of make-up in the package, without regard to whether or not the make-up is packaged in a "blister-pack" or not;

A further object of the present invention is to provide a package wherein changes of product color from package to package is convenient, simple, efficient and reliable.

These and other objects of the present invention are accomplished by a packaging structure according to the present invention wherein a main mounting and packaging element is constructed to define a primary or principal opening into which a make-up product container is inserted in a blister-pack, and the element further defines a secondary opening into which a color strip is mounted to cover less than the entire secondary opening, the color strip being of a color to match the color of the make-up in the container, and preferably transparent.

Other objects and advantages of the present invention will become apparent by reference to the following more detailed description of a preferred, but nonetheless illustrative, embodiment of the present invention, with reference to the accompanying figures, wherein:

FIG. 1 is a perspective view of a packaging structure according to the present invention, showing particularly the product container mounted in a primary opening blister-pack and the color strip mounted in a secondary opening thereof;

FIG. 2 is a front view of the packaging structure of FIG. 1; and

FIG. 3 is a sectional view taken along the line 3—3 of FIG. 2.

This invention is best illustrated by description of a packaging structure for bottled make-up, but it may be seen that the invention is useful otherwise in any packaging structure for a product wherein color is a critical parameter for choice by the purchaser. One example for usage other than with make-up is with respect to packaged pantyhose or stockings, wherein it is not a convenience available to the present purchaser to hold the stocking next to her skin, for instance, where stockings are blister-packed or in a sealed container.

Referring to the drawings, FIG. 1 shows a prospective view of a package according to the present invention. The package is generally designated 10 and includes mating front and back elements, respectively 12 and 14, defining therebetween a narrow opening 16. Mating elements 12, 14 define at their mid-portions an opening 18 generally conforming in shape to the container 20 for the product 22 to be sold therein. In this case, the container 20 is a bottle having a glass main body element 24 and a cap 26.

In the illustrative example described herein, the container 20 is surrounded by a typical plastic blister-pack 28 whose ends 30, 32 are confined between elements 12, 14 by means of staples 34, 36, or the like. In this manner, container 20 is fully exposed, and in this case, completely exposed even to the extent of displaying the color of product 22 through clear glass container 20.

An alternative structure involves the mounting of container 20 in the primary opening of elements 12, 14, without use of a blister-pack, and therefor without staples 34, 36, or the like. Also, heat-sealing can be used in any event.

Importantly, elements 12, 14 further define a small or secondary opening 38, into which is inserted color strip 40, which covers some but not all of opening 38, for reasons to be explained hereinafter. Color strip 40 is held in place by having its ends extend between elements 12, 14 and further, if necessary, by means of staples or the like, as described with respect to blister-pack 28.

Color strip 40 is produced with a color matching closely, if not perfectly, the color or product 22 in container 20. Strip 40 is preferably transparent.

As an alternative embodiment, color strip 40 may be taped or otherwise secured, for instance, with transparent tape, to the back of element 14, near opening 38. In this manner, staples or the like would not be necessary.

Accordingly, by means of the potential purchaser or consumer placing a finger or other skin proximate the package and under opening 38, the true appearance of the color of product 22 with the purchaser's skin is observable. The convenience of opening 38 is not only for matching the product color to one's skin, but also in the case of choosing a make-up color to contrast or blend with one's skin, the structure is useful and efficient.

It is the intention of the structure of the present invention to enable a potential purchaser or consumer to shop in the usual manner for make-up, as an example, in a retail, department or discount store. Once a make-up is chosen by observation of the product or other indicia of color, the package constructed according to the present invention is picked up, as an example, and the consumer's finger held under opening 38 and a definitive observation of the color or product 22 performed, by means of color strip 40, in terms of matching, blending or contrasting with the skin's color and shade.

In this manner, a simple, efficient, reliable structure of a product package is useful in insuring product satisfaction, without relying heavily on close observation techniques; but instead relying upon side-by-side comparison with the product.

What is claimed is:

1. A package for a product having color as a critical parameter for choice, comprising a main mounting and packaging element defining a principal opening to receive said product and a secondary opening; and, a color strip mounted within said secondary opening and covering less than the entire area of said second opening, said strip being of a color matching the color of said product, said product being in a container and said container being mounted within said principal opening.

2. The invention according to claim 1, wherein said container is a bottle.

* * * * *